United States Patent [19]

Watterson et al.

[11] Patent Number: 4,998,725

[45] Date of Patent: Mar. 12, 1991

[54] EXERCISE MACHINE CONTROLLER

[75] Inventors: Scott R. Watterson, River Heights; Donald J. Standing; William T. Dalebout, both of Logan, all of Utah

[73] Assignee: Proform Fitness Products, Inc., Logan, Utah

[21] Appl. No.: 306,872

[22] Filed: Feb. 3, 1989

[51] Int. Cl.[5] ..... A63B 21/5

[52] U.S. Cl. ..... 272/129; 272/69; 272/DIG. 4; 272/DIG. 5; 272/DIG. 6; 128/25 R; 75/379; 434/247; 434/392

[58] Field of Search ..... 272/69, 70, 73, 129, 272/130, DIG. 4, DIG. 5, DIG. 6; 128/25 R; 434/247, 392; 73/379

[56] References Cited

U.S. PATENT DOCUMENTS

| | | | |
|---|---|---|---|
| 4,378,111 | 3/1983 | Tsuchida et al. | 272/73 |
| 4,678,182 | 7/1987 | Nakao et al. | 272/129 X |
| 4,708,337 | 11/1987 | Shyu | 272/69 |
| 4,790,528 | 12/1988 | Nakao et al. | 272/73 |

FOREIGN PATENT DOCUMENTS

| | | | |
|---|---|---|---|
| 0199442 | 10/1986 | European Pat. Off. | 272/134 |
| 0822343 | 11/1979 | Fed. Rep. of Germany | 272/73 |

*Primary Examiner*—Richard J. Apley
*Assistant Examiner*—Joe H. Cheng
*Attorney, Agent, or Firm*—Trask, Britt & Rossa

[57] ABSTRACT

A control console for exercise machines such as treadmills and stationary cycles having a microprocessor to generate signals to control the exercise and to regulate the heart rate of the user by varying the resistance to the exercise.

17 Claims, 15 Drawing Sheets

FITNESS TEST

| STAGE | SPEED | ELEV. | DURATION SECONDS | STEPS | K. CAL/MIN |
|---|---|---|---|---|---|
| 1 | 3.0 | 2.5 | 180 | 17 | 5.81 |
| 2 | 4.0 | 2.5 | 180 | 17 | 6.66 |
| 3 | 5.0 | 5 | 180 | 17 | 10.49 |
| 4 | 6.0 | 5 | 180 | 17 | 10.92 |
| 5 | 7.0 | 7.5 | 180 | 17 | 16.66 |
| 6 | 7.0 | 10 | 180 | 17 | 19.61 |
| 7 | 8.0 | 10 | 180 | 17 | 22.24 |
| 8 | 9.0 | 10 | 180 | 17 | 24.86 |
| 9 | 10.0 | 10 | 180 | 17 | 27.49 |
| 10 | 11.0 | 10 | 180 | 17 | 30.11 |
| 11 | 12.0 | 10 | 180 | 17 | 32.74 |
| | | | | RECOVERY COOL DOWN | |
| 1 | 4.0 | 4 | 180 | 17 | 7.68 |
| 2 | 3.0 | 0 | 180 | 17 | 4.04 |
| 3 | 3.0 | 2 | 180 | 17 | 5.05 |

Fig. 12

AEROBIC TRAINING

| STAGE | SPEED | ELEV. | DURATION SECONDS | STEPS | K. CAL/MIN |
|---|---|---|---|---|---|
| 1 | 1.7 | 3% | 30 | 2 | 2.23 |
| 2 | 3.75 | 4 | 180 | 12 | 7.28 |
| 3 | 4.0 | 6 | 180 | 12 | 9.03 |
| 4 | 4.0 | 0 | 60 | 5 | 4.98 |
| 5 | 5.0 | 6 | 180 | 12 | 10.98 |
| 6 | 4.0 | 0 | 60 | 5 | 4.98 |
| 7 | 5.5 | 6 | 240 | 14 | 11.98 |
| 8 | 4.5 | 3 | 240 | 14 | 7.72 |
| 9 | 5.5 | 8 | 300 | 19 | 13.81 |
| 10 | 5.0 | 5 | 240 | 14 | 11.58 |
| 11 | 6.0 | 5 | 240 | 14 | 11.92 |
| 12 | 6.5 | 8 | 180 | 12 | 16.10 |
| 13 | 5.5 | 4 | 240 | 14 | 10.10 |
| 14 | 7.0 | 2 | 240 | 14 | 10.15 |
| 15 | 7.5 | 5 | 120 | 7 | 14.59 |
| 16 | 6.0 | 0 | 180 | 12 | 6.85 |
| 17 | 7.0 | 5 | 300 | 19 | 13.79 |
| 18 | 6.0 | 2.5 | 300 | 19 | 9.39 |
| 19 | 3.0 | 0 | 180 | 12 | 4.04 |
| 20 | 3.0 | 2 | 180 | 12 | 5.05 |

Fig. 13

REHABILITATION PHASE III

| STAGE | SPEED | ELEV. | SECONDS | DURATION STEPS | K. CAL/MIN |
|---|---|---|---|---|---|
| 1 | 2.0 | 0% | 180 | 9 | 3.00 |
| 2 | 2.5 | 2 | 240 | 12 | 4.41 |
| 3 | 3.0 | 2 | 180 | 9 | 5.05 |
| 4 | 3.0 | 4 | 240 | 12 | 6.07 |
| 5 | 3.5 | 4 | 300 | 14 | 6.87 |
| 6 | 3.5 | 6 | 240 | 12 | 8.06 |
| 7 | 4.0 | 6 | 300 | 14 | 9.03 |
| 8 | 3.5 | 4 | 240 | 12 | 6.07 |
| 9 | 4.0 | 6 | 300 | 14 | 9.03 |
| 10 | 3.5 | 4 | 240 | 12 | 6.87 |
| 11 | 4.5 | 4 | 300 | 14 | 8.48 |
| 12 | 4.0 | 4 | 180 | 9 | 7.68 |
| 13 | 4.5 | 6 | 300 | 14 | 10.10 |
| 14 | 4.0 | 6 | 240 | 12 | 9.03 |
| 15 | 5.0 | 8 | 240 | 12 | 12.67 |
| 16 | 5.5 | 10 | 300 | 14 | 15.67 |
| 17 | 7.0 | 5 | 300 | 14 | 13.79 |
| 18 | 6.0 | 2.5 | 300 | 14 | 9.39 |
| 19 | 3.0 | 0 | 180 | 9 | 4.04 |
| 20 | 3.0 | 2 | 180 | 9 | 5.05 |

Fig. 14

THE FUN RUN

| STAGE | SPEED | ELEV. | DURATION SECONDS | STEPS | K. CAL/MIN |
|---|---|---|---|---|---|
| 1 | 3.0 | 2% | 180 | 10 | 5.05 |
| 2 | 4.0 | 5 | 240 | 14 | 8.35 |
| 3 | 5.0 | 5 | 300 | 16 | 10.14 |
| 4 | 5.5 | 6 | 300 | 16 | 11.96 |
| 5 | 5.0 | 0 | 240 | 14 | 4.98 |
| 6 | 6.0 | 7 | 240 | 14 | 13.94 |
| 7 | 5.5 | 3 | 180 | 10 | 9.17 |
| 8 | 7.0 | 5 | 240 | 14 | 13.70 |
| 9 | 6.0 | 4 | 180 | 10 | 10.91 |
| 10 | 7.0 | 7 | 240 | 14 | 16.07 |
| 11 | 5.5 | 5 | 180 | 10 | 11.03 |
| 12 | 8.0 | 5 | 180 | 10 | 15.84 |
| 13 | 6.0 | 7 | 240 | 14 | 13.94 |
| 14 | 8.0 | 8 | 240 | 14 | 19.53 |
| 15 | 7.0 | 3 | 180 | 10 | 11.34 |
| 16 | 10.0 | 7 | 180 | 10 | 22.42 |
| 17 | 6.0 | 4 | 180 | 10 | 10.39 |
| 18 | 4.0 | 5 | 240 | 14 | 8.36 |
| 19 | 3.0 | 0 | 180 | 10 | 4.04 |
| 20 | 3.0 | 2 | 180 | 10 | 5.05 |

Fig. 15

EXERCISE MACHINE CONTROLLER

BACKGROUND OF THE INVENTION

1. Field

This invention is related to devices for controlling exercise machines and more particularly controls for regulating the performances of exercises by the user in operating the exercise machine.

2. State of the Art

Exercise machines such as treadmills and stationary exercise cycles are widely available and include a variety of features and operational controls. For example, typical treadmills include controls to vary the speed of the tread as well as some type of structure to vary the angle of inclination of the treadmill surface. Adjustments to the angle of inclination are made from time to time in order to regulate what may be viewed as the resistance or the degree of difficulty or hardness of the exercise being performed by the user on the treadmill.

Stationary exercise cycles typically involve some type of flywheel or other rotating mechanism which offers an inertial resistance to simulate what a user might experience if actually pedalling a bicycle on available terrain. In order to simulate uphill travel, and to otherwise simply increase the hardness or degree of difficulty of the exercise being performed on the exercise cycle, resistance structure is typically associated with the flywheel or other rotating mechanism to impose a resistance and in turn vary the degree of difficulty or hardness being experienced by the user while pedalling the stationary cycle.

It appears to be generally accepted that an exercise program undertaken on a regular or repetitive basis over time is a preferred format to secure the best results from the exercise. In order to undertake such a program, it is frequently desirable to perform the same exercises for the same period or increased periods of time or to vary or increase the degree of difficulty for substantially the same time period. In other words combinations of difficulty and duration of selected exercises may be used to start an exercise program to obtain desired goals.

It is presently understood that the pulse rate of the user is a substantial and critical indicator of the level of exercise being undertaken and also an indicator of the degree of benefit being secured thereby. That is, low pulse rates may not be as beneficial to the user as a higher pulse rate exercise even though the degree of difficulty or hardness being imposed is not significantly increased or different.

An exercise control console is therefore desirable to monitor and display to the user the actual heart rate and in turn the benefit being secured from the exercise. An exercise controller is also desirable to regulate the resistance of the involved exercise machine in order to regulate the pulse rate of the user.

SUMMARY OF THE INVENTION

A control console has a chassis for mounting to an exercise machine of the type which has resistance means to resist movement of the user in performing exercises. The resistance is variable between an easy configuration in which resistance to movements of the user is lowest and a hard configuration in which resistance to movements of the user is highest. The control console also includes pulse data means adapted to the chassis to receive pulse signals reflective of the pulse of the user from a pulse detection means. The control console further includes movement data means to receive movement signals reflective of exercise machine movement from movement detection means associated with the exercise machine.

The control console also includes input means adapted to the chassis and operable by the user to supply selected input data signals. Computation means are adapted to the chassis and connected to receive the pulse signals, the movement signals and the input data signals. The computation means then calculates selected output signals that are supplied to a display means which is positioned for viewing by the user. The display means is connected to receive the output signals and to display images reflective of the output signals. The console also includes power supply means adapted to the chassis to supply power to selected components.

In the preferred embodiment the computation means also generates operation signals. Output means are included with the control console and connected to the computation means to receive the operation signals. The output mean is also connected to the exercise machine to supply signals thereto to operate the exercise machine in accordance with the operation signals. The computation means desirably includes memory means to store a preselected program which is selectable by operation of the input means to cause the computation means to generate output signals and operation signals in accordance with the preselected program to operate the exercise machine in accordance therewith.

Preferably the computation means and more particularly the memory means includes a plurality of preselected programs. The resistance means desirably includes adjustment means to vary the resistance between the easy configuration and the hard configuration. The output means is connected to supply selected signals to the adjustment means to operate it between the easy and hard configuration.

In a preferred arrangement, the computation means includes a timer interconnected to a processing unit to supply time signals thereto. The processing unit uses the time signals to calculate selected time based data signals as said output signals which are in turn supplied to the display means. The time based data signals are selected by operation of the input means. The time based signals include time calculated with respect to a reference selected by the user, such as pulse rate and rate of movement.

The input means is operable to supply preselected reference points in a desired arrangement. The computation means compares the reference points to selected data and supplies selected operation signals to the output means when the selected data differs from the reference points. In a more desired arrangement, the preselected reference points includes a target pulse rate and the operation signals include a signal to select a resistance configuration between the easy configuration and the hard configuration to attain the target pulse rate.

The preselected programs cause the computation means to supply operation signals to the output means which in turn signals the adjustment means to cause the resistance to vary and in turn to vary the user's pulse rate in a preselected pattern. In a desired configuration the exercise machine is a treadmill which includes height adjustment means to vary the angle of inclination of the treadmill. The preselected program causes the computation means to supply operation signals to the output means and in turn to the height adjustment means to vary the angle of inclination.

In another configuration, the control console of the invention also includes means within the display means to display the value reflective of the resistance of the resistance means. The display means also has means to graphically depict the preselected programs selected by the user. The display means also has means to display pulse rate, speed and time.

In yet another configuration, the exercise machine may be an exercise cycle of the type with a flywheel and resistance means associated with the flywheel. Resistance means may be a brake positioned about the flywheel. The adjustment means operates the brake tension against the flywheel.

In highly preferred embodiments, the input data signals also include signals reflective of the users age, sex and weight and the output signals include calorie burn rate and total calories burned from a selected reference point.

BRIEF DESCRIPTION OF THE DRAWINGS

In the drawings, which illustrate what is presently regarded as the preferred embodiment:

In FIGS. 6–11, the hollow diamonds represent branching decision points. Labels on the branches extending from points of the diamond refer to the conditions under which the step indicated at the other end of each branch is performed; and FIGS. 12–15 are tables of exercise programs suitable for use in the control console of FIG. 1.

DETAILED DESCRIPTION OF A PREFERRED EMBODIMENT

Figure 1:
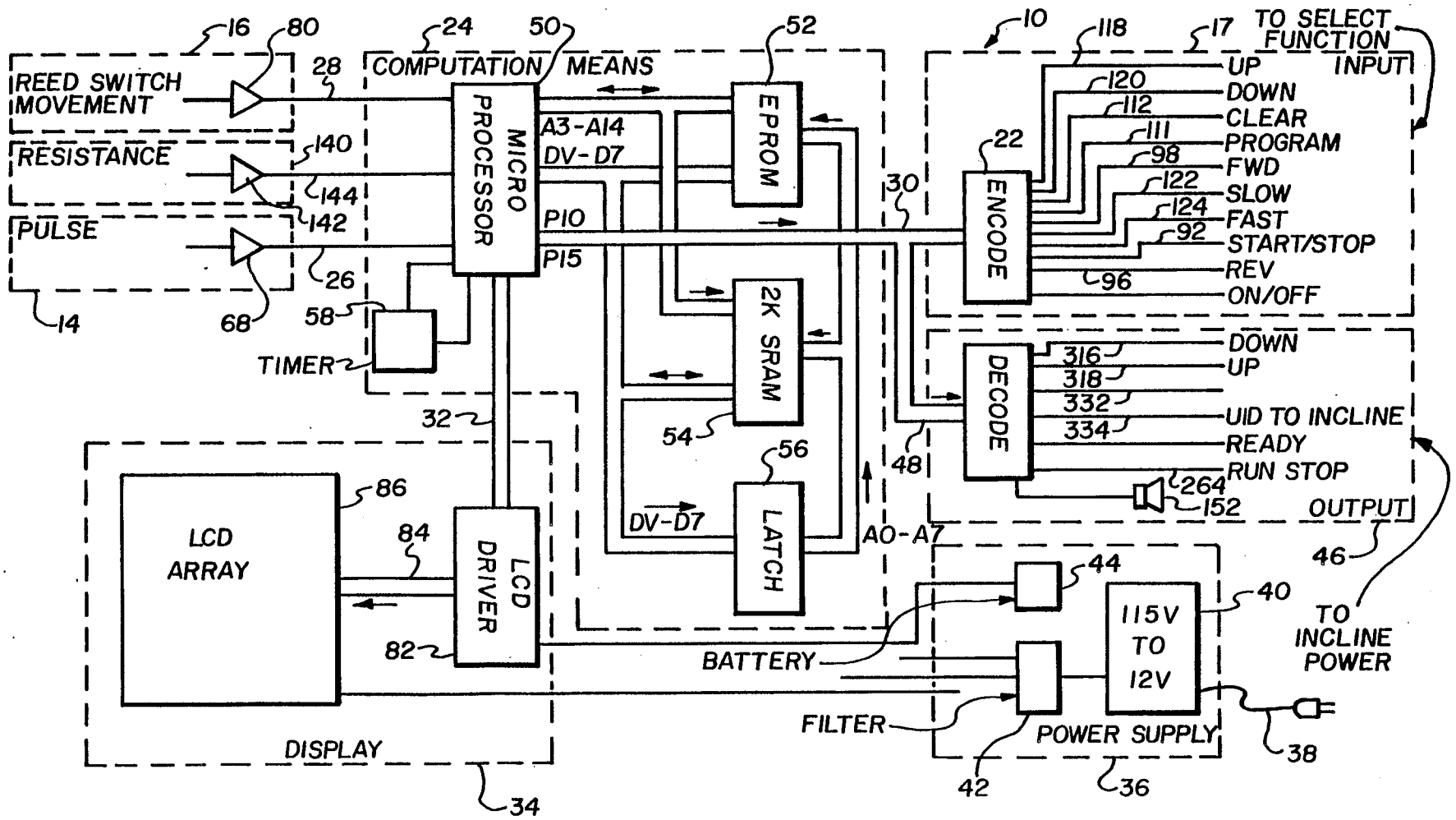
FIG. 1 is a block diagram of the control console of the instant invention.

FIG. 1 is a block diagram depicting the basic components of a control console of the invention. The control console is generally referred to by the numeral 10 and includes a chassis 12 (FIG. 2) for adaptation to an exercise machine by any available means such as clamps, screws or the like. The control console 10 includes pulse data means 14 which is adapted to the chassis 12 and connected to receive pulse signals reflective of the pulse of the pulse of the user from pulse detection means. The console 10 also has movement data means 16 which is adapted to the chassis and connected to receive movement signals reflective of the exercise machine movement from movement detection means associated with the exercise machine.

Figure 2:
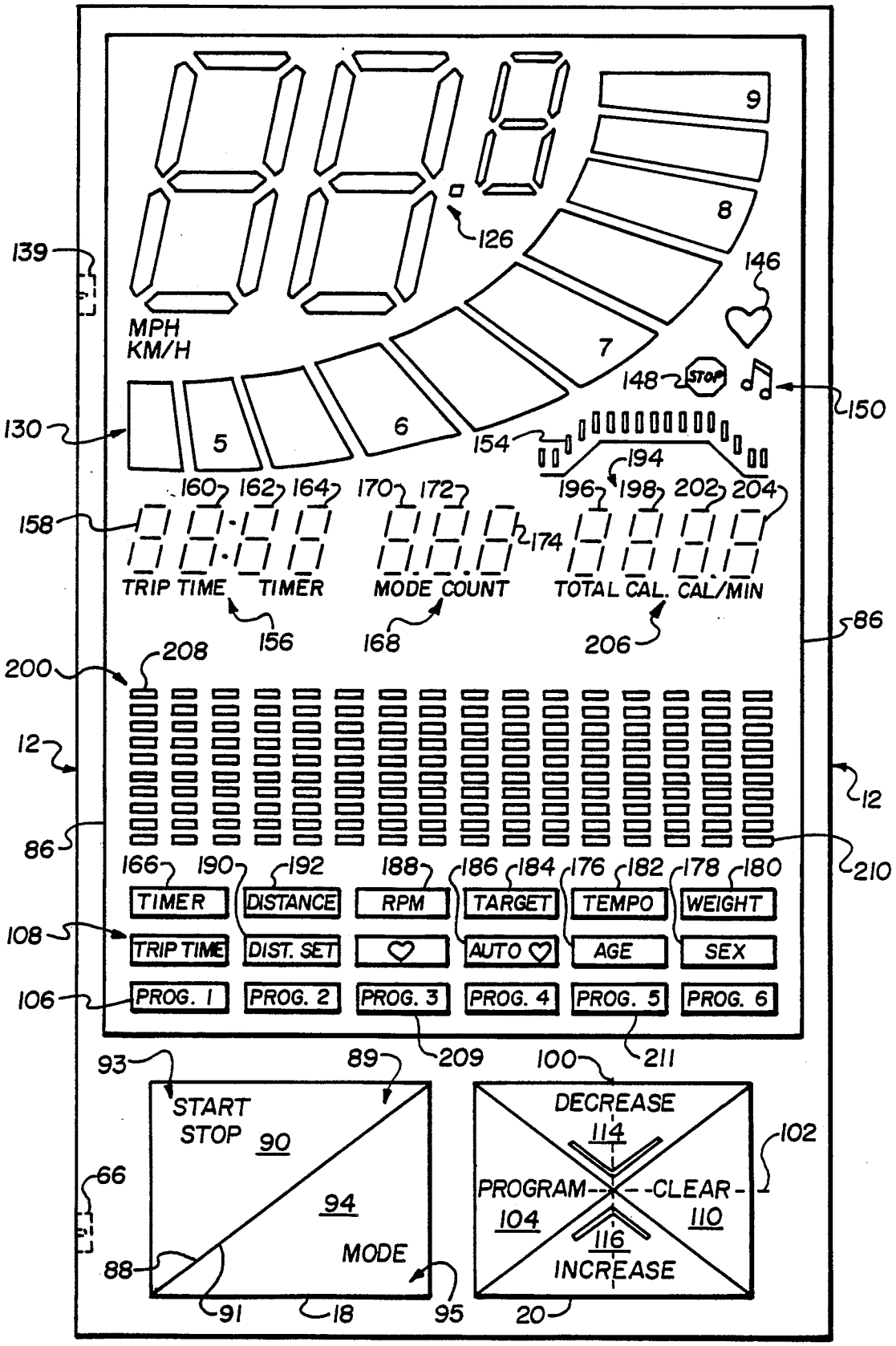
FIG. 2 is a depiction of the front view of a control console of FIG. 1.

The console 10 has input means 17 which, in the illustrated embodiment of FIGS. 1 and 2 includes input buttons 18 and 20 (FIG. 2) and an encoder 22 in FIG. 1. The input means 17 is operable by the user to supply selected input data signals to the console 10.

The console 10 also includes computation means 24 which is connected to receive the pulse signals from the pulse data means 14 via conductor 26 and the movement signals from the movement data means 16 via conductor 28. The computation means 24 also receives the input data signals from the input means 17 via the plurality of conductors 30.

The computation means has means 24 to calculate selected output signals which are supplied via a plurality of conductors 32 to display means 34. The display means 34 is connected to receive the output signals and has means to display images reflective of the output signals.

The console lo also includes power supply means 36 which is here shown connected to receive normal outlet voltage (115 ac) via conductor 38. The outlet voltage is transformed by transformer 40 and filter 42 into 12 volt regulated voltage suitable for use in the various components of the console 10. The power supply 36 may also include a small battery 44 to maintain certain critical functions in the event of power failure.

The control console 10 also includes output means 46 which is connected to receive operation signals via a plurality of conductors 48. The outlet means 46 supplies signals to the exercise machine to cause it to operate as more fully discussed hereinafter.

As best seen in FIG. 1, the computation means 24 includes a microprocessor 50 connected to receive various inputs to calculate the selected values as discussed hereinafter. The microprocessor 50 is interconnected with an erasable, programmable memory (EPROM) 52 and a static random access memory (SRAM) 54. It also includes a latch circuit 56 to lock certain values or latch them during the course of operation as will be understood by those skilled in the art.

As depicted in FIG. 1, the microprocessor 50 is interconnected with the EPROM, the SRAM and the latch in order to receive signals, process them and in turn generate the output signals via conductor 32 and the operation signals via conductor 48 to the display means 34 output means 46 respectively.

The computation means 24 also includes a timer 58 which supplies time signals to the microprocessor 50 which are in turn used to calculate various time based values for display by the display means 34 as will become apparent hereinafter.

The pulse data means 14 shown in FIG. 1 is connected to receive an input from a pulse clip 60 (FIG. 3) which are now available and may be used to clip to the earlobe of the user or some other available appendage in order to sense the pulse of the user. The pulse clip 60 is connected via conductors 62 to a connector 64 for insertion into an appropriate receptacle 66 (FIG. 2). Pulse data is received and processed through the amplifier 68 (FIG. 1) for further transmission via conductor 26 to the computation means 24 and more particularly the microprocessor 50.

The movement data means 16 is connected to receive movement signals from movement detection means. For example in FIG. 4, the movement detection means includes a reed switch 70 which is activated by a magnetic tab 72 which rotates past the reed switch to cause it to send movement signals reflective of rotation via conductor 74. Connector 76 is inserted into receptacle 78 (FIG. 2) to supply the movement data signals for further processing and more particularly amplification by amplifier 80 (FIG. 1). After amplification, the movement data signal is supplied via conductor 28 to the computation means and more particularly to the microprocessor 50. The microprocessor 50 supplies both the operation signals via conductor 48 and output signals via conductor 32. The output signals are supplied to a liquid crystal display driver 82 of the display means 34. The driver in turn supplies signals via a conductor bundle 84 to operate the liquid crystal array 86 which is shown in greater detail in FIG. 2.

A working prototype of the console of FIG. 1 includes the following commercially available electronic parts as known in the art: microprocessor 50, a Hitachi HD6303Q; EPROM 52, a 27C12B chip; SRAM 54, a 2K TC 5516; encoder 22; a 74HC 251; decoder 2, a 74HC 259; latch 56, a 74HC 373; LCD driver 82, a 7228; timer 58, a Watch Dog DS1232. However, as is recognized by persons skilled in the art, any parts performing the same or substantially similar functions can be substituted.

Referring now to FIG. 2, the chassis 12 of the console includes the input buttons 18 and 20 of the input means 17. The chassis 12 also includes the LCD array 86 which displays a variety of values as more fully discussed hereinafter.

In FIG. 2, the buttons 18 and 20 are used to supply a variety of input signals through the encoder 22 to the computation means 24. Button 18 is a two-part switch which rotates about an axis parallel to the dividing line 88. That is, the out surface 89 has a ridge 91 with the surfaces 93 and 95 sloping away from the ridge 91. When the user pushed on the surface 93 it rotates inward about the axis 88. Operation of the upper half 90 supplies start and stop signals via conductor 92 (FIG. 1) to the console 10. The right or lower half 94 is a mode switch used to select various modes of operation hereinafter discussed. The mode signals are supplied via conductors 96 and 98 through the encoder 22 to the computation means 24.

Switch 20 is a bi-axle switch which rotates around a first axis 100 and a second axis 102 which is normal to the first axis 100. With the two axes of rotation, it can be seen that the switch 20 has four quadrants which are operable in a manner similar to that described for the two halves 90 and 94 of switch 18. The left quadrant 104 of switch 20 is operated to select between the various programs as shown by an array of bar indicators 108 in the lower portion of the LCD array 86. The right quadrant 110 of switch 20 supplies a clear signal via conductor 112 through the encoder 22 to the computation means 24. The upper and lower quadrants 114 and 116 or switch 20 are increase and decrease buttons which are used to supply up/down signals via conductors 118 and 120 and slow/fast signals via conductors 122 and 124 as more fully discussed hereinafter.

In FIG. 2, the LCD array 86 includes a speed or rate indicating field 126. That is, the movement data received via the movement data means 16 in the microprocessor 50 may be used in conjunction with time information received from the timer 58 to calculate a speed or rate. If the exercise machine is a treadmill such as the treadmill 128 of FIG. 4, the speed or rate information may be readily calculated using constants to determine either the speed in miles per hours or in kilometer per hour. Other rates may be calculated including meters per second or feet per second as desired by the user with appropriate adjustments made to the computation means as known in those skilled in the art.

The array 86 also includes a graphic depiction 130 of resistance. For example, the treadmill 128 of FIG. 4 includes means to adjust the height 132 and in turn the angle of inclination 134 of the treadmill. The treadmill FIG. 4 has a potentiometer 136 which is positioned to sense the height 132 and in turn the angle of inclination 134. The potentiometer 136 transmits a signal reflective of the height 132 via conductor 138 and Receptacle 139 to resistance data means 140. The signal is amplified by amplifier 142 and supplied via conductor 144 to the computation means 24 and more particularly to the microprocessor 50. The microprocessor 50 generates an appropriate output signal and supplies it via conductors 32 to the display means 34 to show the angle of inclination in the field 130. As seen in FIG. 2, the field 130 includes a depiction of increasing angles which are marked in the blocks with the number 5, 6, 7, 8 and 9. Thus the user may observe the angle while exercising. The resistance of an exercise cycle is more fully discussed hereinafter. Notably the field 130 can display the angle of inclination in small increments. It is here shown to display in half degrees. However, greater precision is available based on the accuracy of the detector such as the potentiometer 136.

The array 86 includes a symbol which is here been selected to be a heart 146 to indicate the pulse of the user. That is, the pulse data means 14 supplies the pulse signal via amplifier 68 and conductor 26 to the microprocessor 50 which supplies a pulse signal to the display means 34. The user's pulse is visually depicted for the benefit of the user by causing the symbol 146 to flash on and off consistent with the pulse of the user. Other indications may be used including a paragraph or a field of numbers to show the user's pulse quantitatively. The array 86 also includes a symbol 148 to indicate that a particular program has been stopped. Here a octagonal stop sign is depicted. However, any other available symbol may be used.

The array 86 also includes a musical note symbol 150 which is activated and flashes whenever an audio signal is generated by the output means 46 via a small buzzer or speaker 152. A user having a hearing impairment may therefore visually recognize the occurrence of an event which causes the audio signal to be generated via the speaker or buzzer 152.

The array 86 also includes a progress array 154. That is, the user may select a program or function which provides for an exercise regimen to be performed over a selected period of time such as 20 minutes. As the exercise proceeds, the various bar lights 154 are illuminated to indicate progress of the user through the program which has been selected.

The array 86 further includes several fields indicating actual data as well as set data. For example, there is a time field 156 consisting of four blocks 158, 160, 162 and 164. In operation, the user operates the mode switch 94 until the timer bar 166 in the bar array 108 is illuminated. Thereafter the increase 116 and decrease 114 quadrants may be used to set a particular desired exercise time. Typical setting could be 15 minutes which the number 1 in block 158, the number 5 in block 160 and the number 0 would appear in both blocks 162 and 164 of the time field 156. Upon initiation of exercise by depression of the start switch 90, the time thus set would start decreasing counting down to 0. Simultaneously the progress of the exercise through the 15 minutes is shown in data field 154. If the mode switch 94 is operated to select trip time, the blocks display the time to complete a particular distance which is termed trip time. Adjacent to the time field 156, is a mode field 168 comprised of blocks 170, 172 and 174. The mode field 168 is used to select a particular function which the user wishes to input into the computation means 24. For example, the user may wish to enter his or her age which is used by the computation means in the calculation of calories. The mode switch is depressed successively until the age block or bar 176 is illuminated. Thereafter the increase 116 and decrease switches 114 are depressed until the appropriate age is indicated in the mode count field 168. Similarly the mode switch 94 can be depressed until the sex bar 178 is illuminated at which time appropriate numbers for example 1 for male and, 2 for female are entered. In a similar fashion the mode switch 94 is used to select weight when the bar 180 is illuminated, tempo or pace which may be regarded as a speed input 182. Similarly the user may also select a target heart rate 184 or an automatic heart rate 186 which is the heart rate supplied from any one of a series of programs which are selected by depression of the program key 104. The mode switch 94 also is used to select a particular RPM or speed for a machine such as the exercise cycle or for a treadmill. The total distance to be traveled may also be set by operating the mode switch until the distance set bar 192 is illuminated. The mode switch 94 is also used to select the distance bar 192 which in turn reflects the display of the actual distance in net miles or kilometers in the mode count blocks 170, 172 and 174.

It is often desirable to know the total number of calories consumed or expended in the performance of a particular exercise as well as the number calories per minute or per other unit of time which are being consumed while exercising. In FIG. 2, the total calories field 194 is shown comprised of blocks 196 198, 202 and 204. The total calories are computed by the computation means 24 and output signals are supplied via conductor 32 through the display means 34 to display it in the LCD array and more particularly in blocks 196, 198, 202 and 204. Similarly the number of calories burned per minute may also be displayed in the same data field 194. A decimal point 206 is shown in the field 194 since the calories per minute are frequently shown in tenths.

The array 86 also includes a data field 200 which is here shown to be comprised of 16 rows 208 of 10 indicators each. This array 200 may be used to indicate any number of different parameters. For example, the speed of a particular program may be here shown as it varies during the time provided for the performance of the particular program. Similarly the resistance or incline of a treadmill may be shown graphically. That is, the bottom horizontal row 21? would be regarded as 0 with the number of vertical blocks being illuminated to show the relative incline, speed or other value being here depicted.

As noted, the LCD array 86 has a program line or series of bars 106 which may be selected by consecutively depressing of the program switch 104. When a particular program is selected such as program 3, the bar 209 would be illuminated and the particular desired parameters of program 3 would be depicted in the array 200.

Various programs are preinserted into the computation means 24 and available for selection by the user. FIGS. 12, 13, 14 & 15 depict four programs which may be desired may be inserted into the computation means 24. For example, program 1 may be a fitness test (FIG. 12) which is for treadmill 128 of FIG. 4. The program has a number of different stages in which the speed along with the elevation or angle of inclination or degrees varies. The length of each stage is shown in seconds. The expected number of steps to be taken by the user is also depicted along with the number of calories per minute being consumed or burned in the performance of the fitness test. Notably the fitness test FIG. 12 also includes a cool down portion as illustrated.

FIG. 13 shows an aerobic training exercise. FIG. 14 shows a rehabilitation exercise; and FIG. 15 shows a jogging or running exercise. Programs may be devised by the user. An empty program is selected by operating the program switch 104 until its respective bar such as bar 211 is illuminated. Various functions (speed, time, heart rate) are selected with the mode switch 94 and using the increase 116 and decrease switches 114 to set the various parameters. The user may thereafter select the program when returning to the machine from time to time to perform sequential exercises on a day to day or week to week basis.

Figure 3:
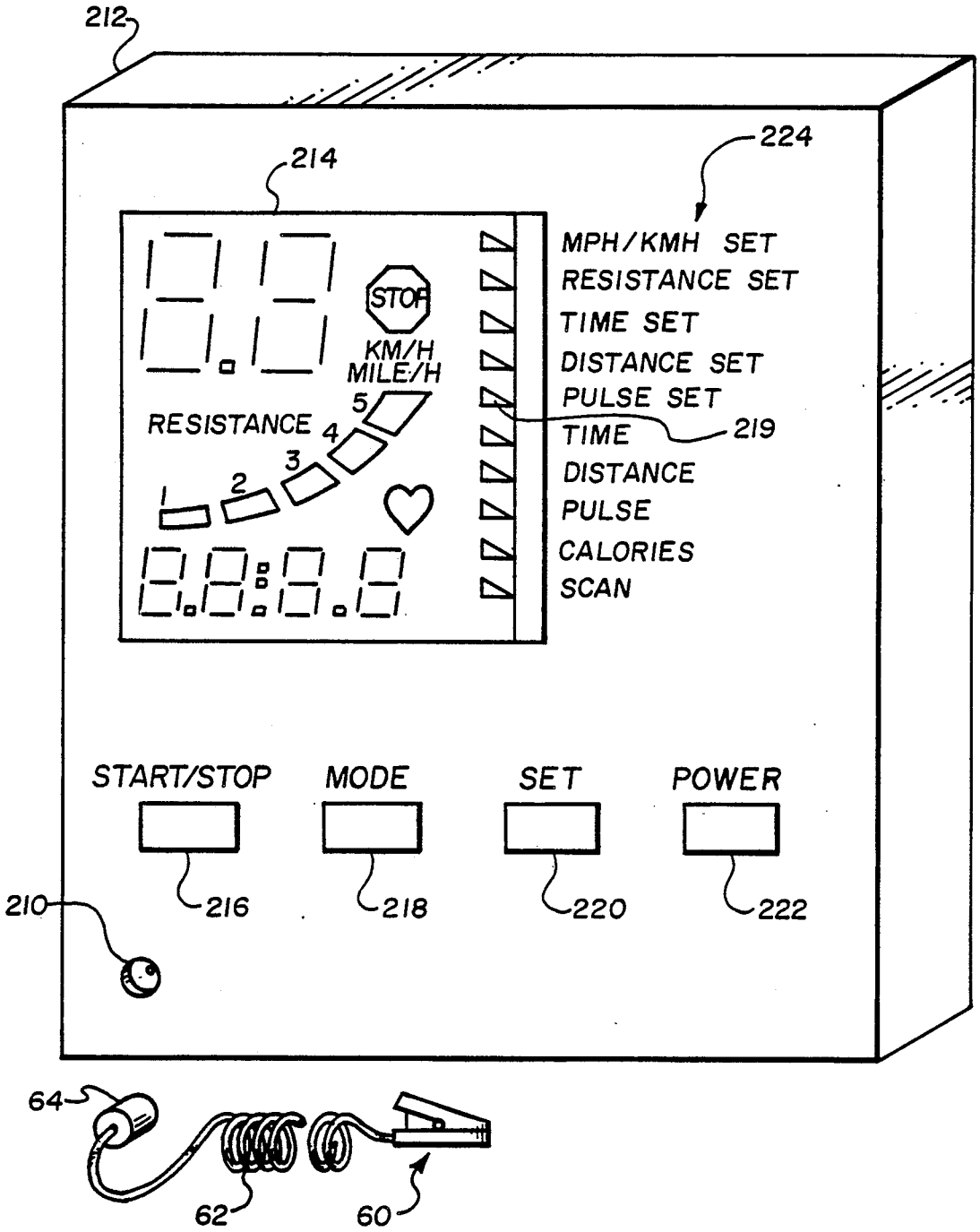
FIG. 3 is a front view of an alternate configuration of a control console of the instant invention.

FIG. 3 shows an alternate arrangement of a control console. Pulse data may be supplied from a pulse clip 60 via conductor 62 and connector 64 into receptacle 10. The control console has a chassis 212 with an LCD array 214 and a series of operating switches including a start-stop switch 216, a mode switch 218, a set switch 220 and a power switch 222. The power switch 222 is used to turn the control console on and off. The start and stop switch 216 is used to start or stop operation of the various functions or modes. The mode switch 218 is used to select any one of a series of modes depicted graphically along the right side 224. When a particular mode such as pulse set is selected using the mode switch 218 the triangle 219 is illuminated and the actual pulse may be inserted using the set switch 220. Operation is substantially as described with respect to the control console 10 of FIG. 1 as depicted in FIG. 2 but without an output circuit 46.

In reference to the console 10 of FIG. 1 and 2 it may be noted that the specific details of each circuit and each function are readily known by reference to FIG. 1 which shows the circuit number of the components. The specific programing structure of the computation means 24 will therefore be readily known to those skilled in the art.

Figure 4:
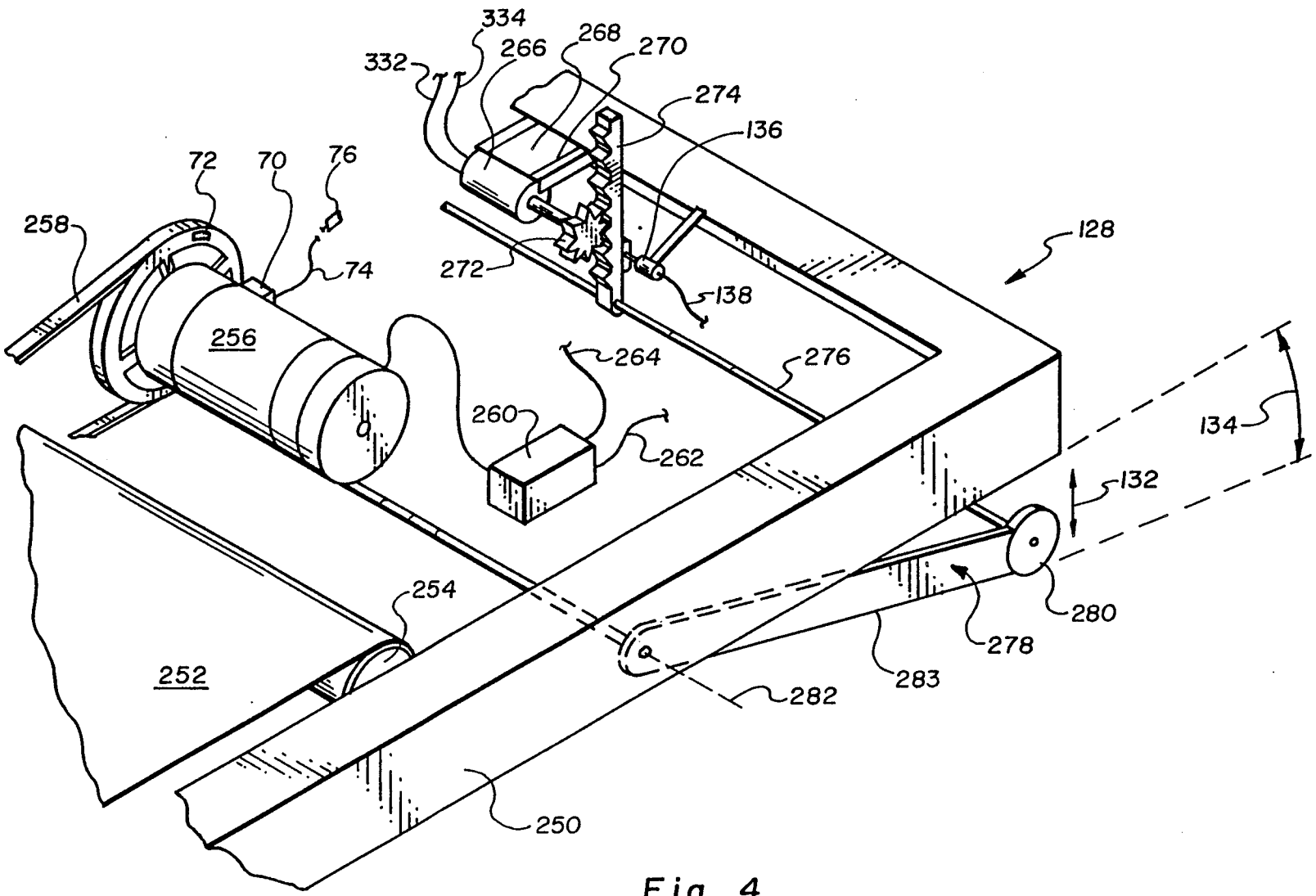
FIG. 4 is a partial cut-away perspective of a treadmill for use with a control console of the invention.

Referring now to FIG. 4, a portion of a treadmill 128 is shown with a frame 250 and a tread 252 which is rotated by a roller 254 powered by a motor 256 and a belt 258. Power to the motor 256 is received via a controller 260 which in turn receives electrical power from an external source via conductor 262. Onoff signals or start-stop signals are received from the control console of FIG. 1 via conductor 264. As noted hereinbefore treadmill 128, may be operated to vary its elevation 132 or angle of inclination 134. As here depicted a small motor 266 is mounted by brackets 268 and 270 to the frame 250. The motor 266 operates the gear 272 in response to up or down signals received via conductors 332,334 to move rack 274 thereby causing axle 276 to move downward or upward with respect to the frame 250 and in turn change the elevation 132 and the angle of inclination 134. As noted hereinbefore, a position indication is detected by a potentiometer 136 which reads the position of the rack 274 and supplies an output signal reflective of the position via conductor 138 through the resistance data means 140 to the computation means 24. As can be seen in FIG. 4, a foot structure 278 includes the axle 276 and a wheel 280 which pivots about axis 282 by Arm 283 to provide for the change of elevation 13 angle of inclination 134.

Figure 5:
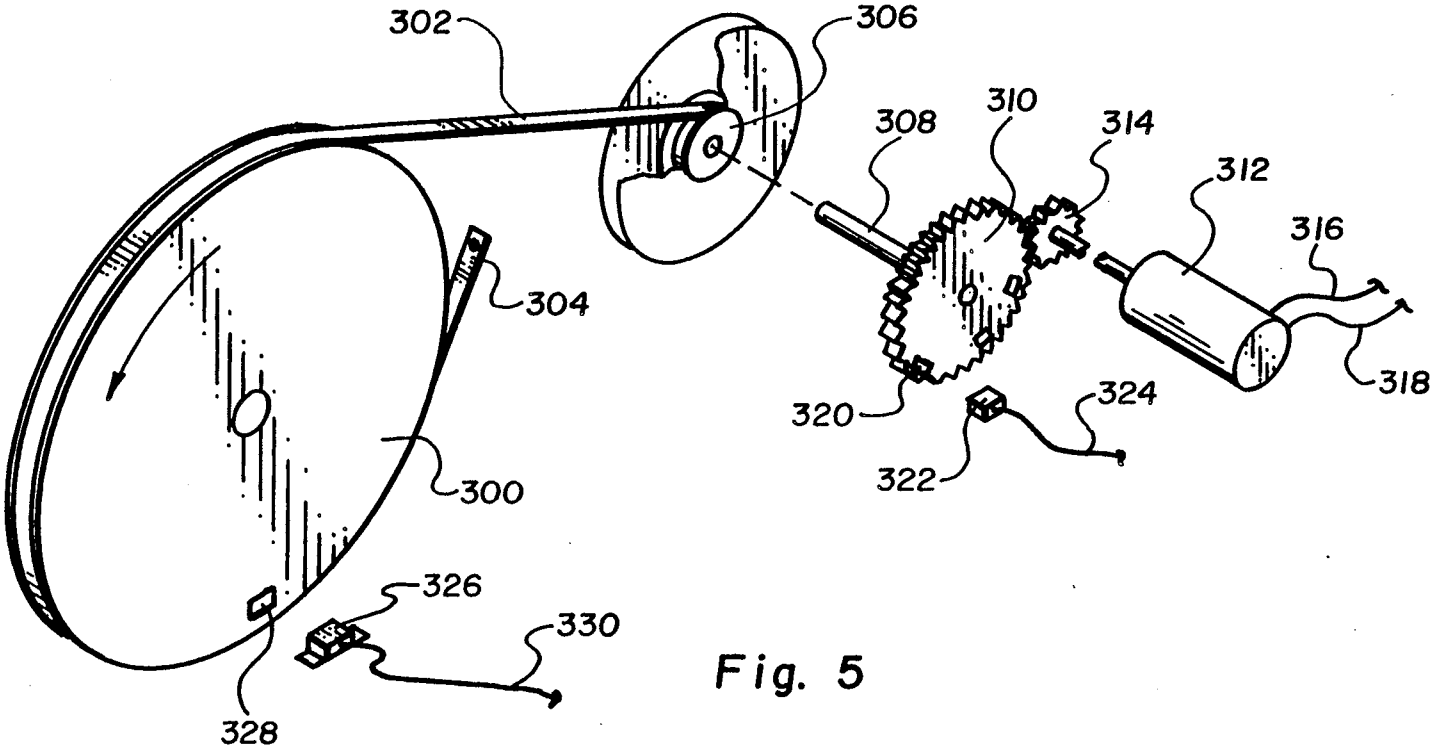
FIG. 5 is a perspective and cut away view of selected parts of an exercise cycle for use with the control console of the instant invention.

Referring now to FIG. 5, a flywheel 300 of a stationary exercise cycle is depicted. A strap 302 is used as a brake or friction structure to provide resistance to rotation of the flywheel 300 by operation of pedals (not shown) by the user. One end of the strap 304 is secured to the frame (not shown) of the exercise cycle. The other end is secured to a drum 306 which is keyed to shaft 308. The shaft has a gear 310 which is operated by a small motor 312 via an interconnecting gear 314. Other brake arrangements may be used such as a caliper brake or even a disc brake. Any arrangement may be used as long as it is adjustable.

With the arrangement of FIG. 5, the resistance being imposed by the strap 302 may be adjusted by causing an up or down signal to be supplied via conductors 316 and 318 to the motor 312 to in turn cause the strap 302 to be tightened and in turn cause more friction against operation or rotation of the flywheel 300. The actual rotation of the gear 310 may be detected by magnetic tabs 320 and a reed switch 322 which supplies a signal via conductor 324 to the resistance data means 140 for further transmission to the computation means 24. Similarly, the movement of the flywheel 300 may be detected by a reed switch 326 positioned to count rotation of a magnetic tab 328. The reed switch 326 signal is supplied via conductor 330 to movement data means 16 for further transmission to the computation means 24.

Referring to FIG. 1, it can be seen that the output 46 supplies as an output signal an increment signal via conductor 332 and an up-down signal via 334 to operate the motor 266 to change the elevation or angle of inclination of the treadmill 128. The up/down signal reverses the polarity of the power to the DC motor 266 and the increment signal causes movement of a predetermined amount.

Figure 6:
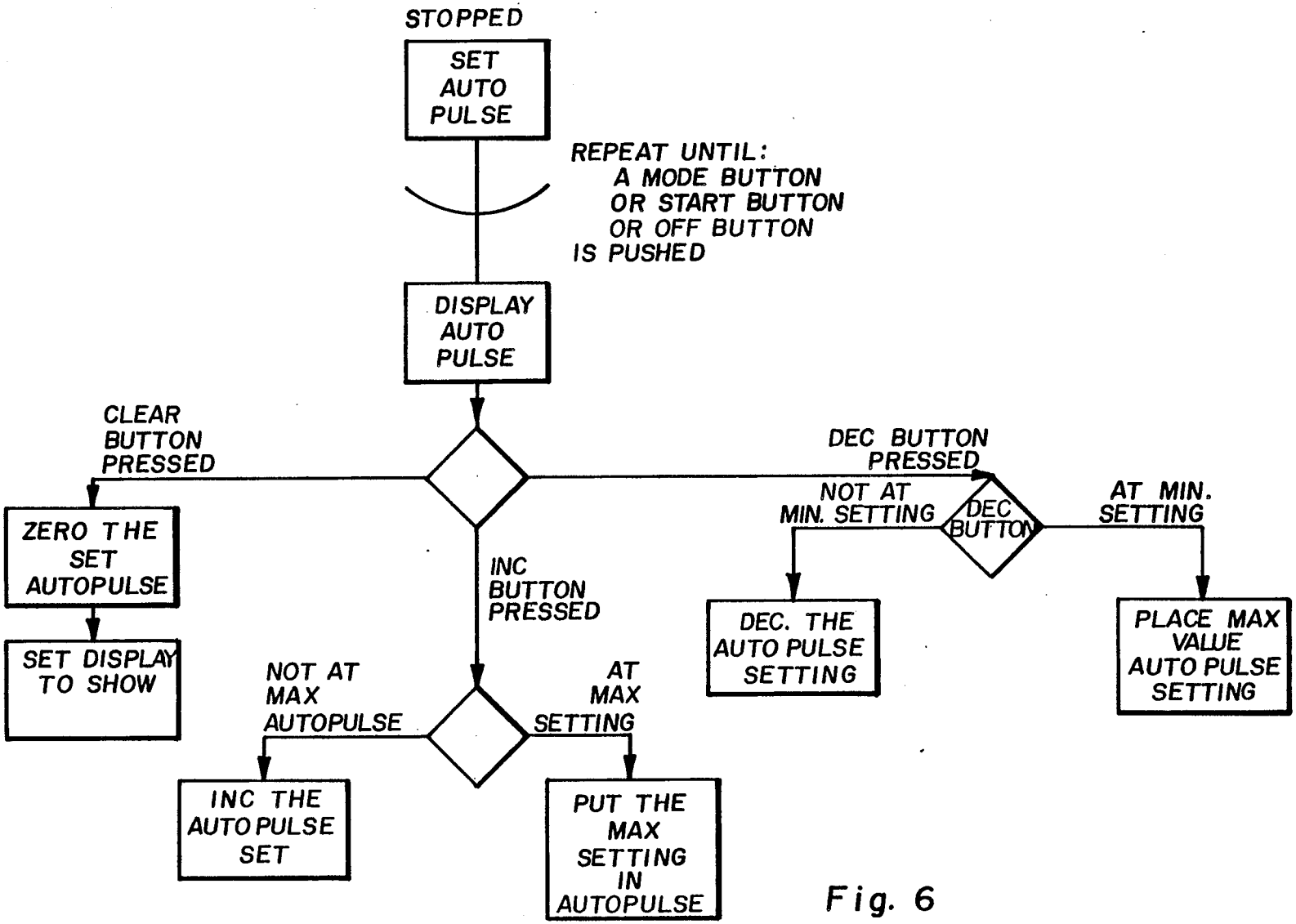
FIGS. 6–11 are block diagrams representing the logic of instructions used in the control console of FIG. 1.
Figure 7:
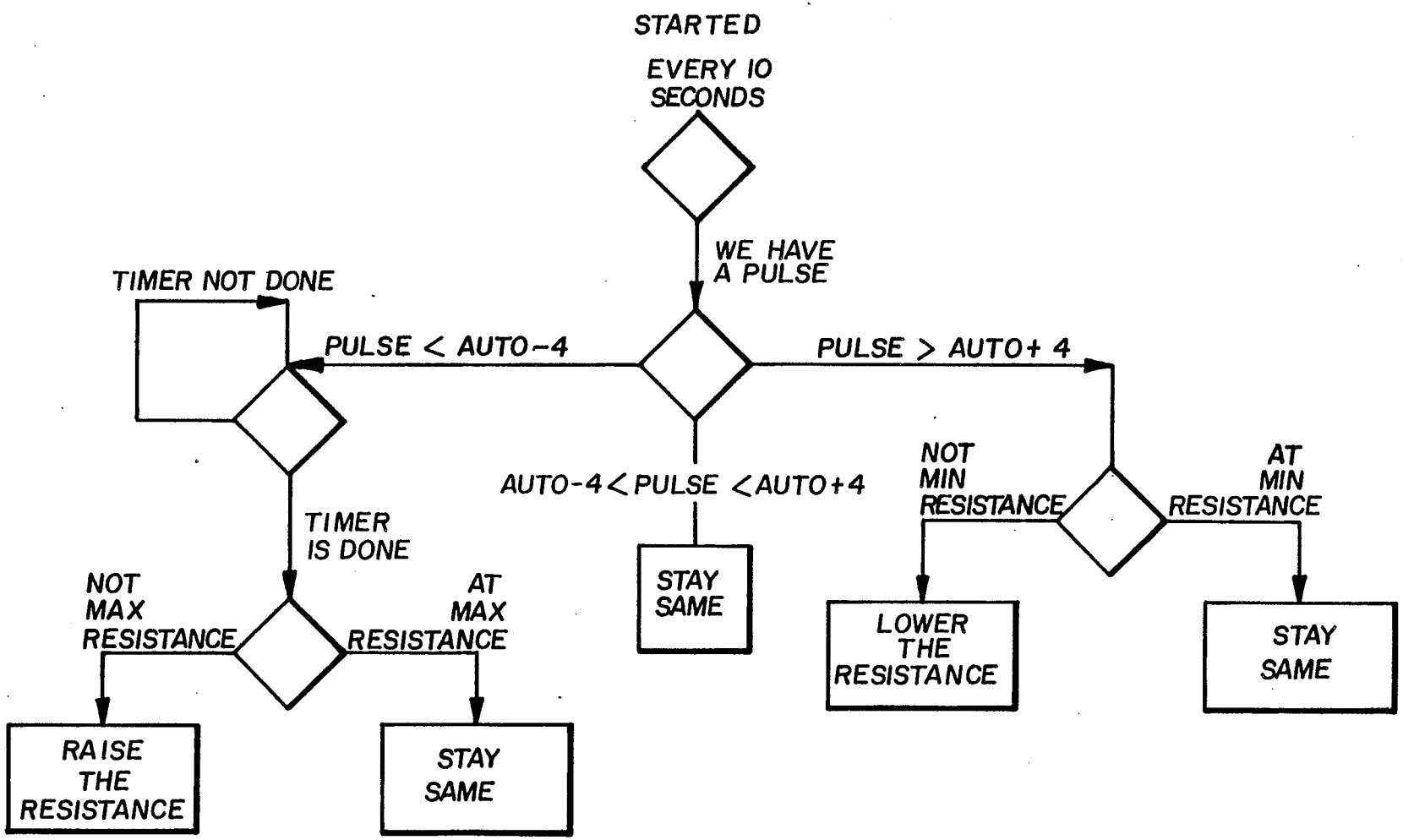

Referring to FIG. 6 a block diagram of the logic contained within the computation means 24 (FIG. 1) is depicted for the auto pulse mode. That is, the auto pulse mode is selected by operation of the mode switch 94 (FIG. 2) until the auto pulse function bar 186 is illuminated. In the auto pulse mode, the logic is to display the auto pulse light 186 in the bar field 108. The program is then inserted to compare the actual pulse to a desired or set pulse. FIG. 7 shows the auto pulse function in operation in which the pulse is sampled every 10 seconds in order to change the incline of a treadmill or brake resistance of an exercise cycle and in turn the resistance being experienced by the user to in turn affect the user's pulse. Here the exercise machine is a treadmill and the incline is raised or lowered in order to affect the user's pulse. For an exercise cycle the strap or brake may be tightened or loosened to affect the resistance and in turn the pulse rate of the user.

Figure 8:
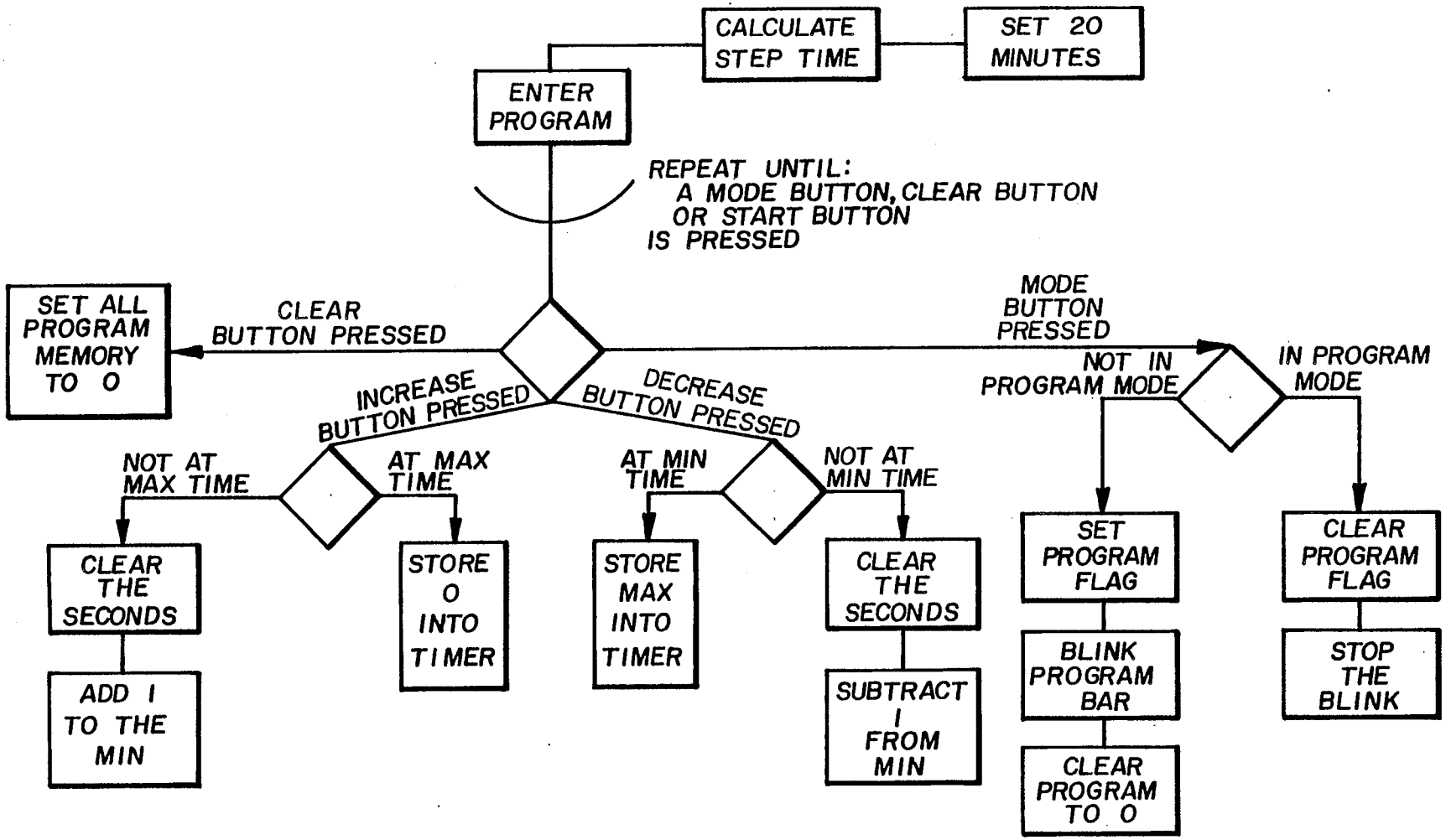
Figure 9:
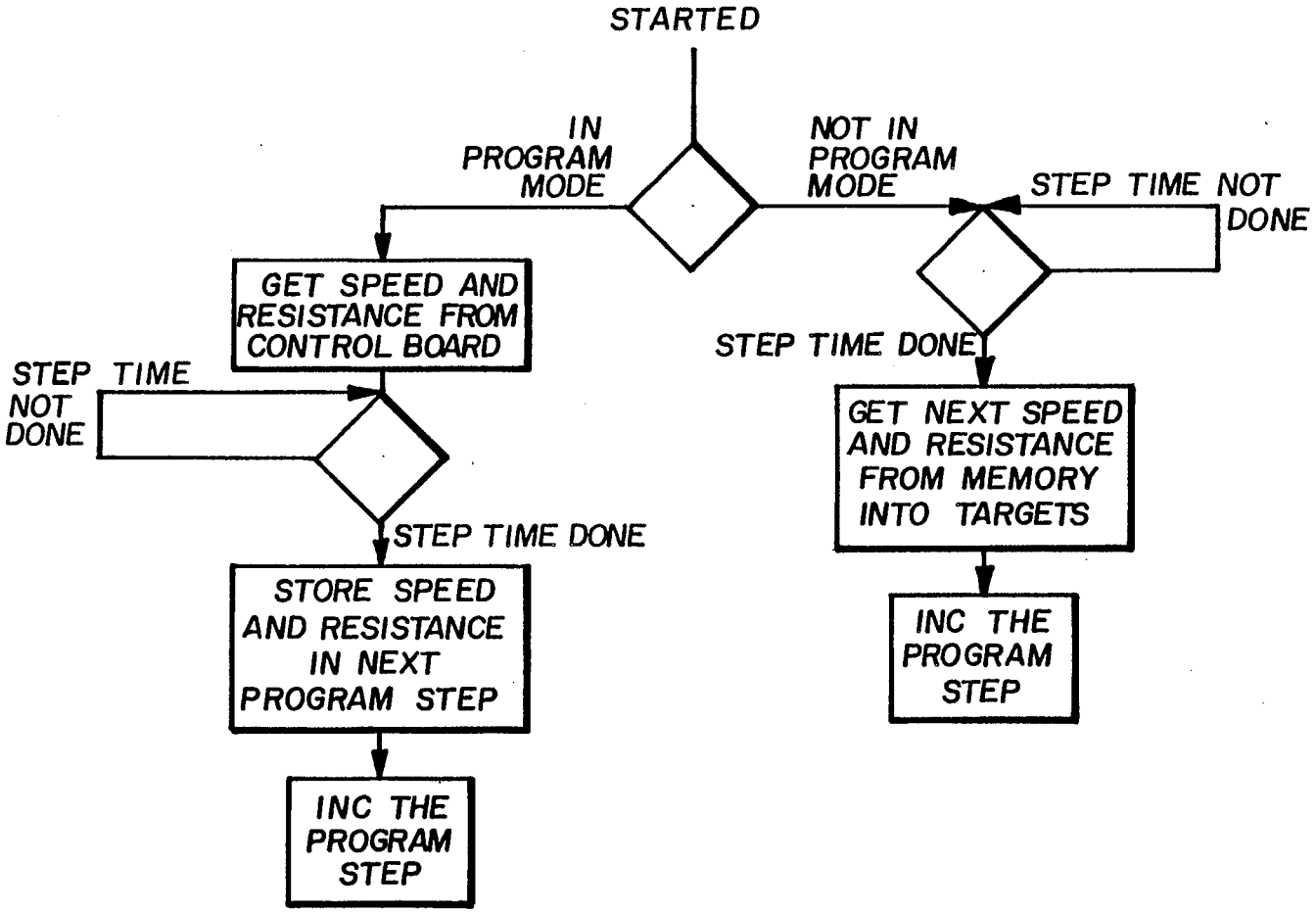

FIGS. 8 and 9 show the logic of the program mode which has been programed into the computation means 24. Here again the start-stop switch 90 is depressed to change between the stop logic (FIG. 8) and the start or run Logic (FIG. 9). Program switch 104 is operated to select a desired program which in turn is implemented upon depression of the start switch 90.

Figure 10:
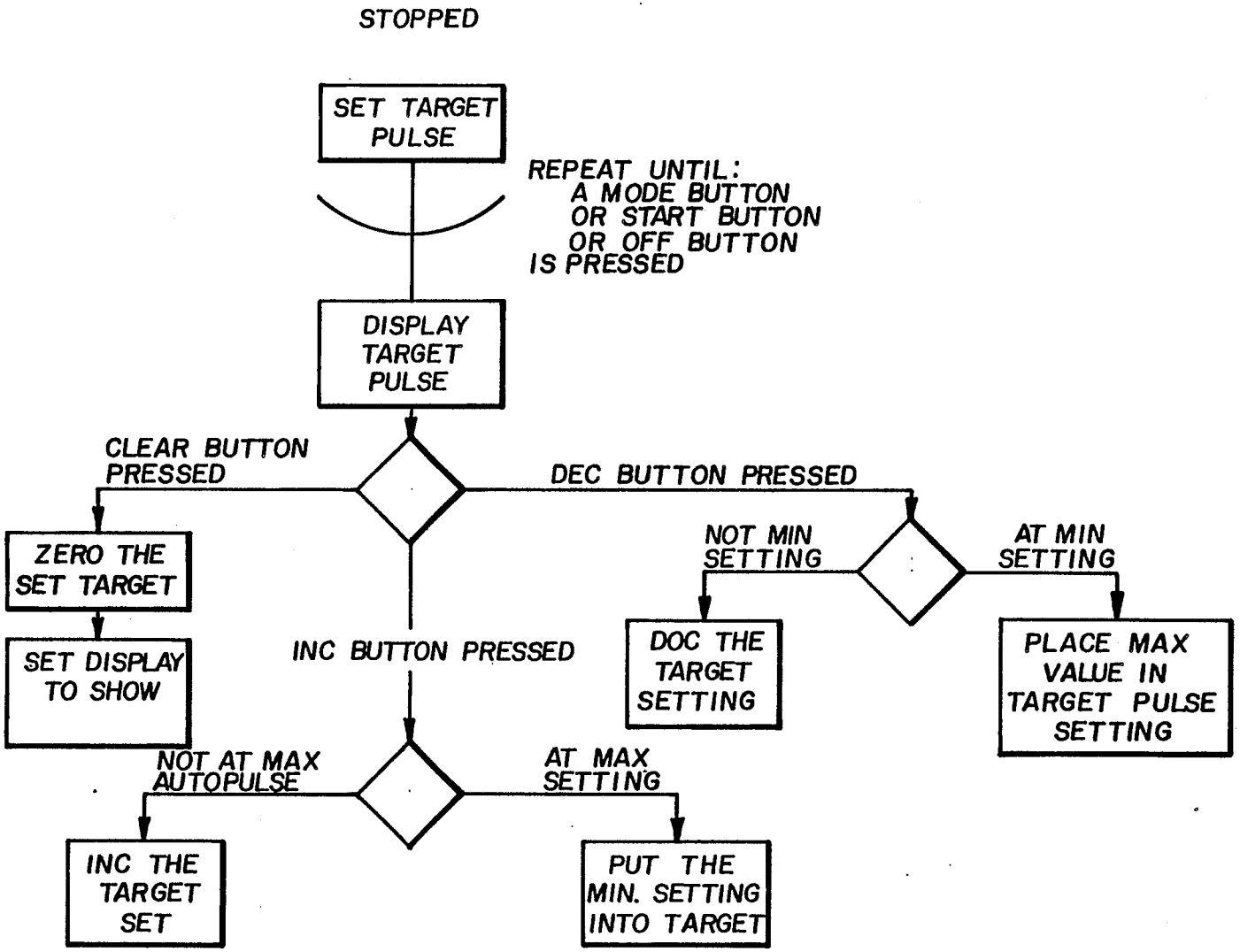
Figure 11:
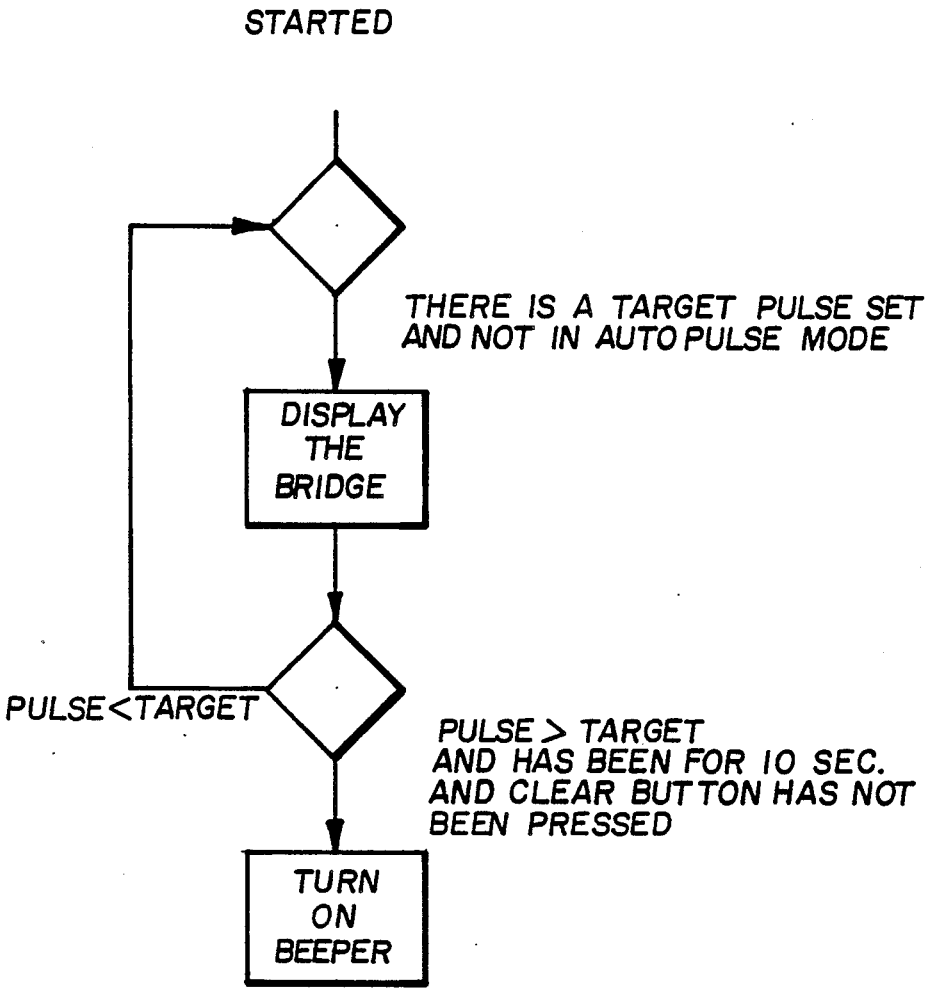

FIGS. 10 and 11 show the logic of the computation means 24 of FIG. 1 for the target pulse function. That is, a target pulse is set in and the machine is operated by the user upon depression of the start switch 90. When the target pulse is exceeded, the audio signal beeper 152 is activated as is its corresponding visual indication 150.

In operation, the control console of FIGS. 1 and 2 may be adapted to an exercise machine such as the treadmill 128 of FIG. 4 in a position for observation and operation by the user exercising on the treadmill. Typically it is placed on a post or bar at waist height in front of the user as known to those skilled in the art. The user positioned on the exercise treadmill will first energize the treadmill and in turn the console. An on-off switch is typically provided on associated consoles adjacent to the console of FIG. 2, whereafter the user operates the start-stop switch 90 to start and stop the treadmill the user will also use the mode switch 94 and the program switch 104 to select the desired form and format of the exercise to be performed. The clear switch 110 may be used to clear the memory; and the increase switch 116 and decrease switch 114 may be used as hereinbefore stated to set the appropriate values in the data fields of the LCD display and in turn in the computation means 24 The machine will operate in the particular desired mode such as the speed or auto pulse mode or until a particular distance has been achieved. In operating the exercise machine with the use of the control console of FIG. 2, the user is thus able to control all other factors or features of the exercise being performed on the machine.

It may be noted that the embodiments herein described are merely illustrative of the application of the principals of the invention. Reference herein to details of the illustrative embodiment is not intended to limit the scope of the claims which themselves recite those features regarded as essential to the invention.

We claim:

1. In an exercise machine having resistance means for exerting resistance to exercise movements performed by an user thereon, resistance adjustment means for varying said resistance means between an easy and a hard configuration, resistance detection means for detecting said resistance and providing resistance signals reflective thereof, movement detection means for detecting said exercise movement and providing movement signals reflective thereof, pulse detection means for detecting the pulse of said user and providing pulse signals reflective thereof, and a control console, said control console including an encoder for receiving said resistance signals, movement signals and pulse signals, timer means for providing time reference signals, input means operable by said user to select exercise parameters including desired pulse rate and duration of exercise and to provide input signals reflective thereof to said encoder, computation means for computing and generating operating signals and display signals in response to said resistance signals, pulse signals, movement signals and input signals from said encoder, and time signals from said timer means, memory means for storing preset programs selectable by operation of said input means to provide a sequence of program signals to said computation means which in turn generates said operating signals in accordance with said preset programs, wherein said user selecting a desired operating mode and one or more exercise parameters corresponding to said desired operating mode by operation of said input means, and said computation means generating said operating signals according to said selected operating mode, display means for receiving and providing a display representative of said display signals, and output means for supplying said operating signals to operate said exercise machine, the improvement wherein:

said computation means compares said pulse signals to reference points specified by a preset program from said memory means and in response thereto supplies said operating signals via said output means to said resistance adjustment means for varying the resistance to achieve changes in said user's pulse rate as prescribed by said preset program, and said memory means is further operable to receive and store an user-designed exercise program based on reference points and exercise parameters selected by said user via said input means, and wherein said input means is operable by said user to select said user-designed exercised program, said exercise parameters further including speed of the exercise movement and total simulated distance of the exercise movement, and said reference points including an upper limit pulse rate and desired pulse rates.

2. An improvement according to claim 1, wherein said user's pulse is sampled at 10 second intervals and said operating signals to said resistance adjustment means are provided at 10 second intervals.

3. An improvement according to claim 1, wherein said preset operating modes include an auto pulse mode in which said user selects a desired pulse rate by operation of said input means, and said computation means supplies operating signals via said output means to said resistance adjustment means for varying said resistance to maintain said user's pulse at said desired pulse rate.

4. An improvement according to claim 3, wherein said preset operating modes further include exercise duration, simulated distance traveled, and upper limit pulse rate.

5. An improvement according to claim 3, wherein the plurality of preset programs stored by said memory means includes a rehabilitation exercise providing for gently controlled exertion suitable for a user recovering from illness or inactivity, an aerobic training exercise providing sustained exertion at a level sufficient to enhance a user's aerobic condition, a fun run exercise providing moderate exertion, and a fitness test in which a user's fitness may be tested, said fitness test having a cool-down segment wherein the user's level of exertion is gradually reduced from its maximum to the resting level.

6. An improvement according to claim 3, wherein said display means includes graphical representations of exercise parameters, said graphical representations comprising arrays of lights.

7. An improvement according to claim 6, wherein said graphical representations include a resistance display comprising an ordered arrangement of indicators wherein each indicator corresponds to the an individual resistance value and is operable between an activated and a deactivated condition in response to said resistance signals, said indicator being activated when said resistance signal corresponds to said individual resistance value and deactivated when said resistance signal differs from said individual resistance value.

8. An improvement according to claim 7 wherein said indicators of said resistance display are lights arranged a direction extending upwardly and away from the user of the exercise machine in an ascending sequence according to rank of said individual resistance value, from a nearest position corresponding to the lowest said value to a most distant position corresponding to the highest said value.

9. An improvement according to claim 7 wherein said graphical representations include a progress display comprising a series of indicators arranged substantially in a horizontal orientation direction, each of said series of indicators corresponding to a specific fraction of total exercise time and being activated when the elapsed time from the start of the exercise is substantially equal to said specific fraction and deactivated when said elapsed time is not equal thereto.

10. An improvement according to claim 9 wherein said exercise program includes a maintenance phase in which an user's exertion is maintained at a desired level, a warm-up segment and a cool-down segment in which the exertion of said user is respectively gradually increased to said desired level and decreased to said desired level, and said series of indicators being arranged to have subsets of said of said indicators corresponding to said said warm-up segments and said cool-down segments displaced in a direction relative to those of said indicators corresponding to the maintenance phase of said exercise program, wherein said direction being substantially orthogonal to said horizontal orientation direction.

11. An improvement according to claim 9 wherein said input means includes a two-part switch, said two part switch operable by pressure exerted on a first part to send stop and start signals to said computation means and said output means, and further operable by exertion of pressure on a second part to send mode-selecting signals to said computation means and said output means.

12. An improvement according to claim 11 wherein said input means further includes a bi-axle switch having four quadrants, said bi-axle switch operable by pressure on a first quadrant to send program selection signals to said computation means and said output means, operable by pressure on a second quadrant to send clear signal to said computation means and said output means, operable by pressure on a third quadrant to send up and down signals to said computation means and said output means and by pressure on a fourth quadrant to send slow and fast signals to said computation means and said output means.

13. An improvement according to claim 12 wherein said display means includes means to display pulse rate, speed and time, and wherein said display signals from said computation means includes signals reflective of pulse rate, speed and time.

14. An improvement according to claim 13 wherein said input signals include signals reflective of said user's age, sex and weight and wherein said display signals further include signals reflective of the calorie burn rate and total calories burned during a specified portion of an exercise period.

15. An improvement according to claim 14 wherein said exercise machine is a treadmill and said resistance adjustment means adjusts the angle of inclination of said treadmill, and wherein said preset program causes the computation means to supply operation signals via said output means to said adjustment means to vary the angle of inclination as referred by said preset program.

16. An improvement according to claim 15, wherein said operating modes further include a speed mode in which said user selects a desired treadmill speed by operation of said input means.

17. An improvement according to claim 16, wherein said resistance detection means is a potentiometer.

* * * * *